United States Patent [19]

Edmundson

[11] Patent Number: 5,070,630

[45] Date of Patent: Dec. 10, 1991

[54] DECORATIVE CAST COVER

[76] Inventor: Ross Edmundson, 114 Romney Marsh, Longwood, Fla. 32779

[21] Appl. No.: 408,330

[22] Filed: Sep. 18, 1989

[51] Int. Cl.[5] ..... A43B 00/00

[52] U.S. Cl. ..... 36/110; 36/1.5

[58] Field of Search ..... 36/110, 2 R, 1.5, 100, 36/101

[56] References Cited

U.S. PATENT DOCUMENTS

| | | | |
|---|---|---|---|
| 2,229,563 | 1/1941 | Greenstein | 36/2 R |
| 2,494,701 | 1/1950 | Gogerty | 36/110 |
| 3,221,421 | 12/1965 | Liebmann et al. | 36/100 |
| 3,566,487 | 11/1969 | Beightol | 36/110 |
| 3,820,254 | 6/1974 | Kopacsi | 36/110 |
| 3,905,135 | 9/1975 | Debusk | 36/110 |
| 4,217,706 | 8/1980 | Vartanian | 36/110 |
| 4,301,603 | 11/1981 | Scott | 36/110 |
| 4,713,895 | 12/1987 | Vallières | 36/1.5 |
| 4,726,127 | 2/1988 | Barouk | 36/110 |
| 4,850,122 | 7/1989 | Schwab, Jr. | 36/100 X |

FOREIGN PATENT DOCUMENTS

| | | | |
|---|---|---|---|
| 0059440 | 6/1913 | Austria | 36/2 R |
| 1533522 | 7/1967 | France | 36/110 |
| 2441350 | 7/1980 | France | 36/110 |
| 2536963 | 6/1984 | France | 36/110 |
| 0020252 | 9/1915 | United Kingdom | 36/2 R |

*Primary Examiner*—Paul T. Sewell
*Assistant Examiner*—Ted Kavanugh
*Attorney, Agent, or Firm*—William M. Hobby, III

[57] ABSTRACT

A decorative cast cover apparatus has a plurality of materials shaped to fit over a rigid cast on a patient and shaped in a three dimensional decorative shape and formed to hide the cast. The decorative cast cover is fastened to the cast with fastening members such as VELCRO fasteners. A foam polystyrene is used to form a predetermined decorative shape, such as a shoe and sock, and a fabric material can be formed onto the polystyrene to provide a cast cover which looks like a shoe and sock covered foot and may have shoelaces passing through grommets in the fabric covering of the cast cover.

3 Claims, 1 Drawing Sheet

DECORATIVE CAST COVER

BACKGROUND OF THE INVENTION

The present invention relates to cast covers and especially to a decorative three dimensional cast or splint covers which covers the cast on a patient.

In the past, a wide variety of rigid casts and splints, as well as flexible casts, have been provided for use on patients with broken or damaged bones or the like. Typically, a plaster cast is used for a broken bone and is formed a patient's limb, such as the arm or leg, with a hardening material to hold the leg and bone in place. Some splints are made of rigid polymers which can be snapped onto the patient to act as a cast or splint to hold the leg or arm rigid while the bone heals. Typical prior art splints or casts can be seen in U.S. Pat. No. 4,727,865 to Hill-Bryne for a replaceable rigid cast with integral fasteners which immobilizes an injured body part by fitting over the damaged body part and has adjustable fastening members for immobilizing a body part. In the Seeley U.S. Pat. No. 3,850,167 a splint is provided having flexible corrugated material providing a central support base and opposing support walls and connected with straps to immobilize the body part. In the Castle U.S. Pat. No. 3,695,258 a disposable splint immobilizes a body member and wraps around the body member and straps thereto. In the Murray U.S. Pat. No. 3,197,534, a method of forming a thin resilient shell on a body member uses a cheese cloth and gypsum.

In one prior art patent to Bergen U.S. Pat. No. 3,548,820, a splint liner provides a soft cushioning liner for surgical splints especially metallic splints used in cases of fracture. The liner can be easily sterilized and reused to cushion the rigid splint.

The present invention acts as a cushioning liner but is directed towards a decorative cover for the splint which provides a more athletic appearance to the rigid splint and especially to a three dimensional cast cover which emulates a three dimensional sculpture or object such as a shoe and sock.

SUMMARY OF THE INVENTION

A decorative splint or cast cover is formed of a plurality of pieces of material shaped to fit over a rigid splint on a patient with the material shaped in a three dimensional shape and formed to hide the cast. Fastening members allow for attaching material to a person's splint in a manner to conceal the splint. The splint cover can be formed of a foam polymer material, such as polystyrene, and covered with a fabric material to form the three dimensional object, such as a shoe having laces with a sock extending therefrom. The decorative cover is split along the rear of the cast cover and may have VELCRO fasteners which can adjust the cover to different size splints. The decorative cover can have an athletic shoe shape having shoelaces laced through eyelets in the shoe to give a true athletic shoe appearance with an athletic sock protruding therefrom.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
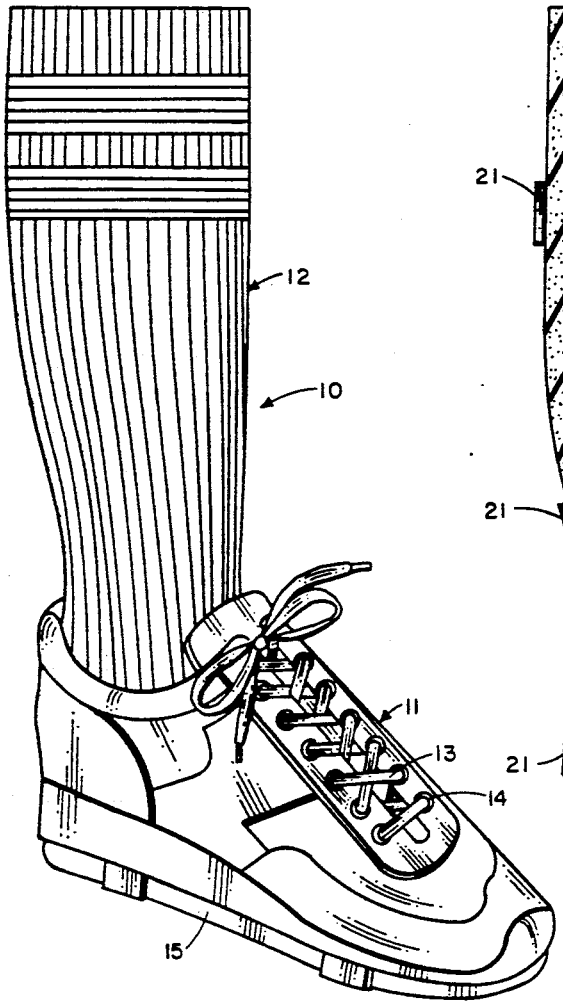
FIG. 1 is a perspective view of a decorative splint cover in accordance with the present invention.
Figure 2:
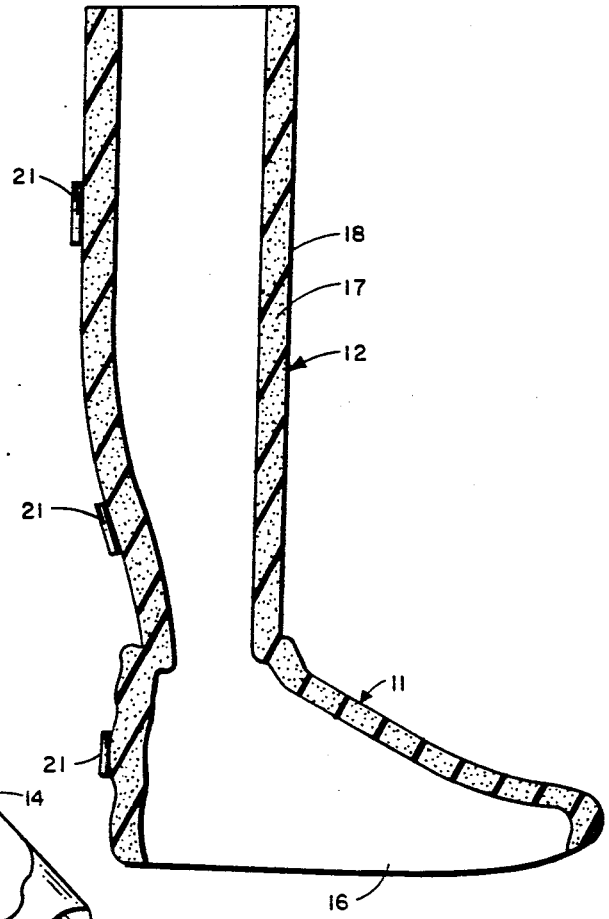
FIG. 2 is a sectional view taken through the decorative splint cover of FIG. 1.
Figure 3:
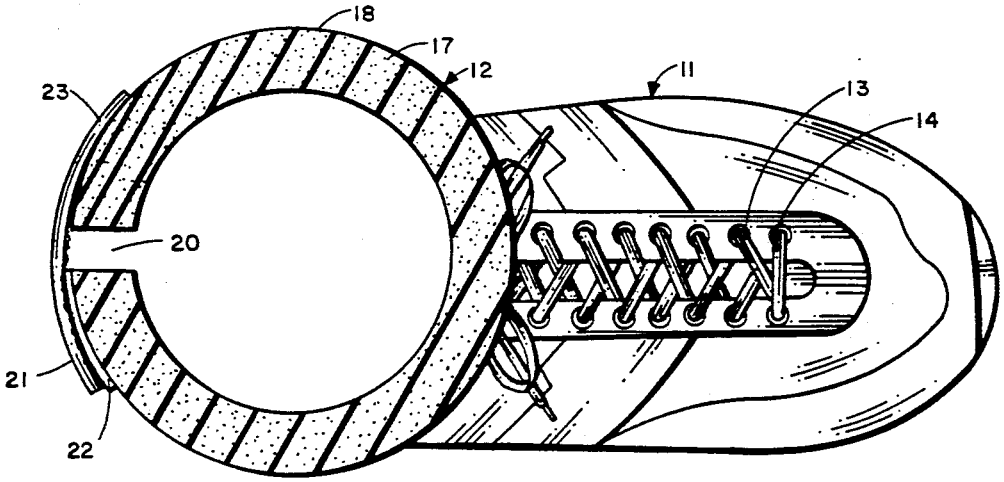
FIG. 3 is a sectional view taken across the sock portion of the decorative splint cover of FIG. 1.

Referring to the drawings, a decorative splint or cast cover 10 is illustrated having a shoe portion 11 and a sock portion 12. The shoe portion 11 has shoelaces 13 threaded through eyelets 14 and is in the shape of an open area 16 in place of the sole. Cast cover 10 is formed with a three dimensional foamed polymer 17, such as a polystyrene foam, which has a degree of flexibility to it. It is formed in a three dimensional shape and covered with a fabric 18. The eyelets and laces 13 may be true shoe eyelets which have been laced with the shoelaces 13. The outer portion of the sock portion may be a sock which is adhesively attached to the foamed polymer 17. Both the shoe portion and the sock portion have a split 20 down the back thereof so that the entire cast portion can be slippd over a cast and attached with a piece of hook and loop material 21 and 22, such as a hook and loop material sold under the trademark VELCRO. The loop material 22 can be placed on both sides of the split 20 while the hook material 21 can be strapped thereover, or alternatively, the hook material can be adhesively attached at 23 to the other side of the split 20 so that it straps over onto the loop material 22 on the other side of the split 20. By pulling the strap 21 tight, the cast cover can be adjusted by bringing the gap 20 closer together or further apart as desired to make a better fit onto the cast and to align the cover for different size splints. Cast cover 10 is preformed with a molded foam polymer 17 and the fabric is then attached thereover in any desired color. Cast cover 10 is preformed with a molded foamed polymer 17 and the fabric is then attached thereover in any desired color. In addition, the sole edge portions 15 may be a rubber or elastomer material to emulate a true athletic shoe so that the final product resembles a shoe and sock except for being a larger size than what the patient would normally wear.

It should be clear at this point, that a decorative splint cover has been provided which is three dimensional to form a specific shape, such as a shoe and sock, but it should also be clear that other three dimensional sculptural shapes can be formed by molding or forming a foamed polymer material 17 to any shape desired and then coating or covering the polymer with a fabric or flexible coating material, such as an elastomer coating, to thereby convert a patient's splint into a decoorative sculpture. Accordingly, the present invention is not to be construed as limited to the forms shown which are to be considered illustrative rather than restrictive.

I claim:

1. A decorative cast covering comprising:

a plurality of pieces of material shaped to fit over a rigid cast on a patient, said material being shaped in a three dimensional decorative shape and formed to hide said cast, and one said material comprising a foamed polymer formed into a predetermined shape and a second said material having a fabric material attached to said foamed polymer material to form a decorative shape and said plurality of materials including a portion thereof shaped to resemble an athletic shoe, said shoe shaped material having an open portion therein on the bottom of the cast and said one material is formed into the shape of a shoe having shoelaces thereon and having a sock extending therefrom over the remainder of the cast, and said shoe and sock being split in a line along the rear thereof; and fastening means for attaching said material to a persons cast in a manner to conceal said cast, said fastening means includes a plurality of hook and loop fasteners.

2. A decorative cast cover in accordance with claim 1 in which said hook and loop fasteners are attached to the back of the separatable sock and athletic shoe shape.

3. A decorative cast cover in accordance with claim 2 in which said foamed polymer is a foamed polystyrene plastic covered with a fabric material and having fabric shoelaces threaded to eyelets in some decorative shoe shape.

* * * * *